US007406179B2

(12) United States Patent
Ryan

(10) Patent No.: US 7,406,179 B2
(45) Date of Patent: Jul. 29, 2008

(54) SYSTEM AND METHOD FOR DETECTING THE INSERTION OR REMOVAL OF A HEARING INSTRUMENT FROM THE EAR CANAL

(75) Inventor: Jim G. Ryan, Ottawa (CA)

(73) Assignee: Sound Design Technologies, Ltd., Burlington, Ontario (CA)

( * ) Notice: Subject to any disclaimer, the term of this patent is extended or adjusted under 35 U.S.C. 154(b) by 428 days.

(21) Appl. No.: 10/812,826

(22) Filed: Mar. 30, 2004

(65) Prior Publication Data

US 2004/0196992 A1 Oct. 7, 2004

Related U.S. Application Data

(60) Provisional application No. 60/459,565, filed on Apr. 1, 2003.

(51) Int. Cl.
*H04R 25/00* (2006.01)

(52) U.S. Cl. ..... 381/312; 381/328

(58) Field of Classification Search ..... 381/312, 381/317, 318, 321, 328, 71.6, 83, 93, 380, 381/72, 94.1, 60
See application file for complete search history.

(56) References Cited

U.S. PATENT DOCUMENTS 4,596,902 A 6/1986 Gilman
4,644,292 A * 2/1987 Kunugi et al. ..... 330/279
4,955,729 A 9/1990 Marx
4,985,925 A * 1/1991 Langberg et al. ..... 381/71.6
5,003,606 A 3/1991 Bordewijk
5,201,006 A 4/1993 Weinrich
6,118,878 A 9/2000 Jones
6,151,400 A 11/2000 Seligman
6,404,895 B1 6/2002 Weidner
6,405,093 B1 * 6/2002 Malcolm et al. ..... 700/94
6,498,858 B2 12/2002 Kates
6,671,379 B2 12/2003 Nemirovski
6,687,377 B2 * 2/2004 Voix et al. ..... 381/60
2002/0076057 A1 6/2002 Voix

OTHER PUBLICATIONS

European Search Report dated Feb. 3, 2006.

* cited by examiner

*Primary Examiner*—Huyen D Le
(74) *Attorney, Agent, or Firm*—Van Dyke, Gardner, Linn & Burkhart, LLP

(57) ABSTRACT

A hearing instrument system detects the insertion or removal of a hearing instrument into a space and includes first and second acoustic transducers, first and second level detection circuitry, and signal processing circuitry. The first acoustic transducer receives a first electrical signal and in response radiates acoustic energy, and the second acoustic transducer receives radiated acoustic energy and in response generates a second electrical signal. The first level detection circuitry is operable to receive the first electrical signal and generate a first intensity signal, and the second level detection circuitry is operable to receive the second electrical signal and generate a second intensity signal. The signal processing circuitry is operable to receive the first and second intensity signals and compare the first and second intensity signals and determine whether the hearing instrument is inserted into the space or removed from the space based on the comparison.

29 Claims, 8 Drawing Sheets

SYSTEM AND METHOD FOR DETECTING THE INSERTION OR REMOVAL OF A HEARING INSTRUMENT FROM THE EAR CANAL

This patent application claims the benefit of priority to U.S. Provisional Application Ser. No. 60/459,565, filed on Apr. 1, 2003, the entire disclosure of which is incorporated herein by reference.

TECHNICAL FIELD

The technology described in this patent application relates generally to the field of hearing instruments. More particularly, the application describes a system and method for detecting the insertion and removal of a hearing instrument from the ear canal. This technology may have utility in any hearing aid, listening device or headset having an output that is delivered into a sealed ear (circumaural earcup) or ear canal (insert earphone, hearing aid, etc.).

BACKGROUND

When a hearing instrument is removed from the ear canal, the increased acoustic coupling between the receiver (loudspeaker) and the microphone can cause howling or feedback. Furthermore, the device is typically not in use when removed. Therefore, knowledge that the device has been removed can be used to lower the acoustical gain to prevent feedback and/or to reduce power consumption by switching the unit off or entering a low-power standby mode.

Conversely, when the unit is re-inserted, knowledge that the device has been inserted can be used to automatically restore gain and power. In a communications headset, this information can be used to automatically answer an incoming call or to terminate a completed call.

Additionally, a hearing instrument is designed to have an acceptable acoustic response when sealed with a user's ear. However, when initially fitted or when in later use, the hearing instrument may not form a proper seal. Accordingly, an audiologist or user may need to determine whether the hearing instrument has formed a proper seal.

SUMMARY

A hearing instrument system for detecting the insertion or removal of a hearing instrument into a space comprises first and second acoustic transducers, first and second level detection circuitry, and signal processing circuitry. The first acoustic transducer is configured to receive a first electrical signal and in response radiate acoustic energy, and the second acoustic transducer is configured to receive radiated acoustic energy and in response generate a second electrical signal. The first level detection circuitry is operable to receive the first electrical signal and generate a first intensity signal, and the second level detection circuitry is operable to receive the second electrical signal and generate a second intensity signal. The signal processing circuitry is operable to receive the first and second intensity signals and compare the first and second intensity signals and determine whether the hearing instrument system is inserted into the space or removed from the space based on the comparison.

An electronically-implemented method of determining whether a hearing instrument is removed from or inserted into a space comprises monitoring the level of acoustic energy radiated by the hearing instrument, monitoring the level of acoustic energy received by the hearing instrument in response to the acoustic energy radiated by the hearing instrument, comparing the level of acoustic energy radiated by the hearing instrument to the level of acoustic energy received by the hearing instrument in response to the acoustic energy radiated by the hearing instrument, and determining whether the hearing instrument is inserted into the space or removed from the space based on the comparison.

A method of determining whether a hearing instrument is removed from or inserted into a space comprises monitoring the level of acoustic energy radiated by the hearing instrument over a frequency band; monitoring the level of acoustic energy received by the hearing instrument over the frequency band in response to the acoustic energy radiated by the hearing instrument when the hearing instrument is inserted into the space; comparing the level of acoustic energy radiated by the hearing instrument to the level of acoustic energy received by the hearing instrument over the frequency band when the hearing instrument is inserted into the space to obtain first comparison data; monitoring the level of acoustic energy received by the hearing instrument over the frequency band in response to the acoustic energy radiated *y the hearing instrument when the hearing instrument is removed from the space; comparing the level of acoustic energy radiated by the hearing instrument to the level of acoustic energy received by the hearing instrument over the frequency band when the hearing instrument is removed from the space to obtain second comparison data; and identifying stable band differentials between the first comparison data and the second comparison data for the monitoring insertion and removal events.

DETAILED DESCRIPTION

A system for detecting the insertion and removal of a hearing instrument (e.g., a hearing aid, a headset, or other type of hearing instrument) from the ear canal includes a loudspeaker driving into a sealed acoustic cavity, a microphone that is acoustically coupled to this sealed cavity, and signal processing circuitry used to determine if the cavity is sealed or not. The acoustic data associated with the loudspeaker and microphone is processed by the signal processing circuitry to automatically control the power consumption or acoustical gain of the hearing instrument.

In a hearing aid, gain reduction can be used to prevent howling due to feedback when the device is not properly seated in the ear canal, or when the device is removed from the ear canal or loose in the ear canal. This is a convenience feature to the user since the presence of howling is often a nuisance. In addition, power consumption can be reduced because many processing features may be deactivated when the device is outside the ear canal.

In a communications headset, the automatic detection of an insertion can be used to provide a hands-free method of answering an incoming call and the automatic detection of a removal can be used to put the headset into a standby or low-power mode. Both of these actions help eliminate acoustic feedback and extend battery life.

Figure 1:
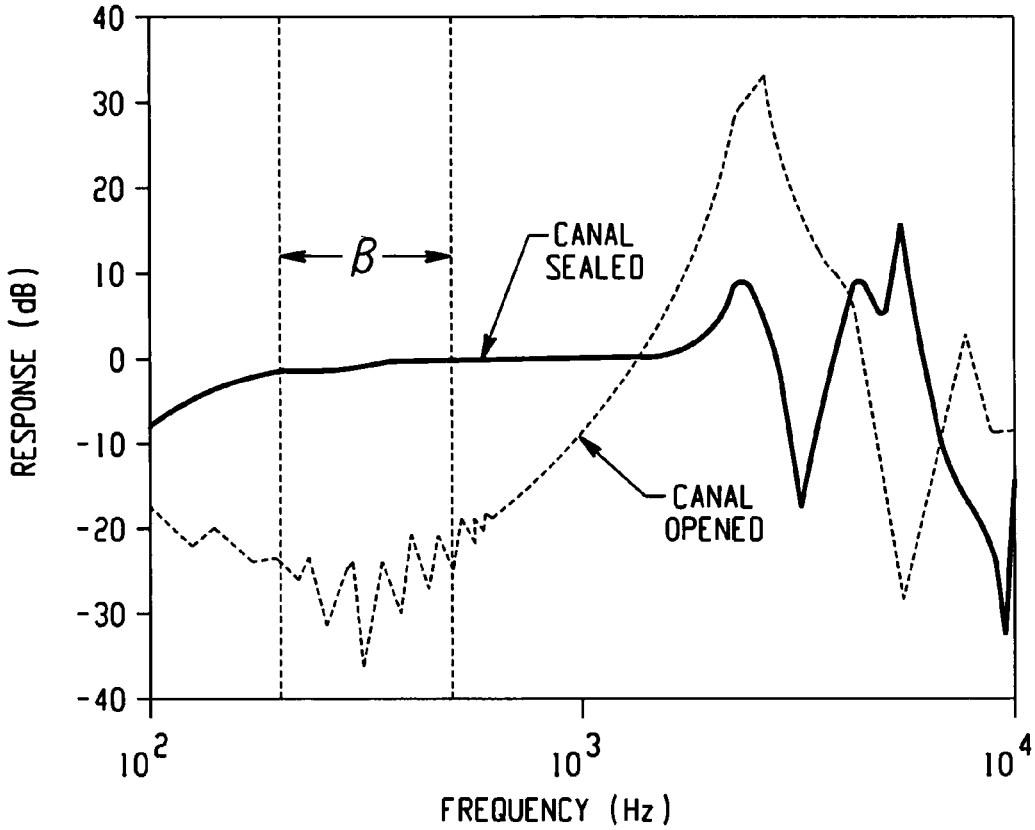
FIG. 1 is a graph of the relative acoustic output of a typical hearing instrument receiver in a sealed acoustic cavity and in free space.

FIG. 1 is a graph of the relative acoustic output of a typical hearing instrument receiver in a sealed acoustic cavity and in free space. Hearing instruments are often sealed against the ear to provide adequate low-frequency response from miniature transducers. When such a device is operated into an unsealed cavity (or free space) then the low-frequency response drops sharply, as shown in FIG. 1.

Figure 2:
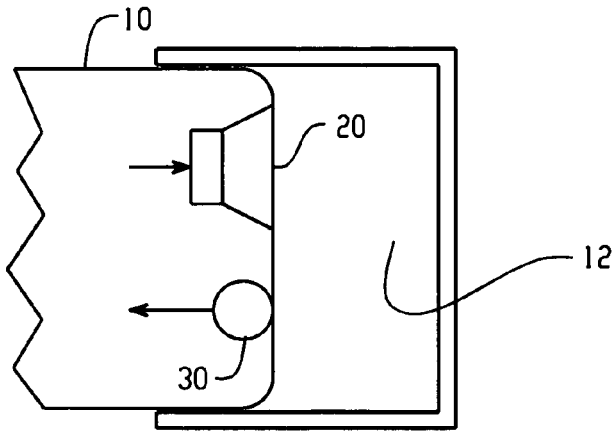
FIG. 2 depicts a loudspeaker operating in a sealed acoustic cavity having a measuring microphone.

By placing a pressure-sensitive microphone inside the sealed acoustic cavity, the frequency response can be measured as the loudspeaker is operating. One such exemplary circuit is depicted in FIG. 2, which illustrates a hearing instrument 10 having a loudspeaker 20 and a measuring microphone 30. The loudspeaker 20 receives a first electrical signal and radiates acoustic energy into in a sealed acoustic cavity 12, and the microphone 30 receives a portion of the acoustic energy radiated by the loudspeaker 20 and generates a second electrical signal in response. The loudspeaker 20 and the microphone 30 may be realized by acoustic transducers commonly utilized in hearing instruments.

Figure 3:
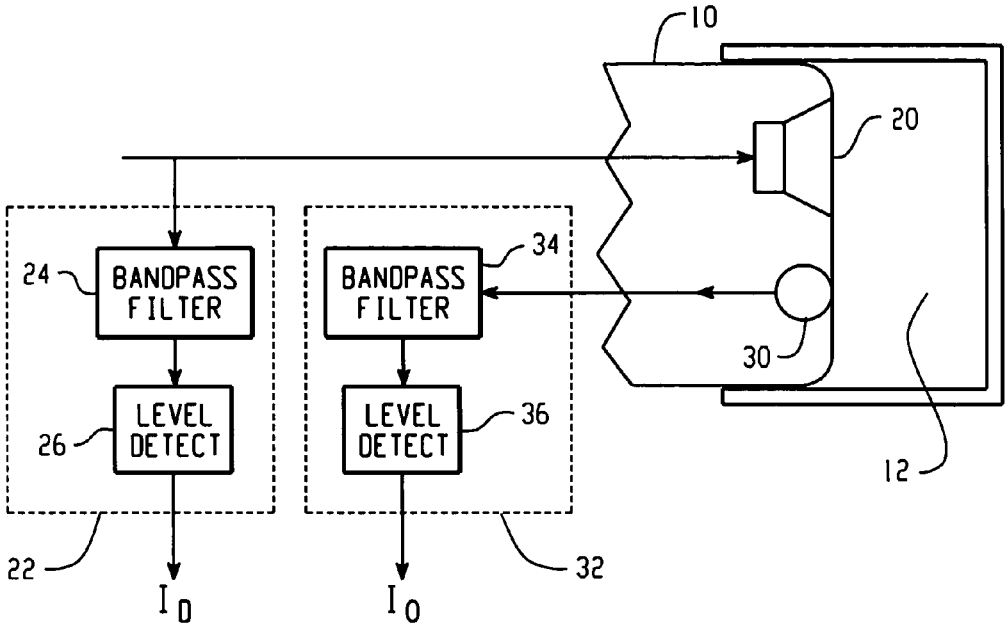
FIG. 3 is a block diagram of a signal processing system for automatically detecting the insertion or removal of a hearing instrument.

FIG. 3 is a block diagram of a signal processing system for automatically detecting the insertion or removal of a hearing instrument 10. The signal processing system is typically implemented in the hearing instrument 10, but may alternatively be located in associated electronics, such as in a telephone base in electrical communication with a communication headset hearing instrument. An automatic system for detecting when the cavity 12 is sealed simultaneously monitors the low-frequency signal levels at the input to the loudspeaker 20 to obtain a loudspeaker drive level, and the low-frequency signal levels at the output of the microphone to obtain an acoustic output level. The loudspeaker 20 is coupled to a first level detection circuitry 22 that is operable to receive the first electrical signal and generate a first intensity signal $I_D$. In one embodiment, the first level detection circuitry 22 comprises a bandpass filter 24 and a level detector 26.

The microphone 30 is coupled to a second level detection circuitry 32 that is operable to receive the second electrical signal and generate a second intensity signal $I_O$. In one embodiment, the second level detection circuitry 32 comprises a bandpass filter 34 and a level detector 36.

The bandpass filters 24 and 34 limit the frequency range of the detection circuitry 22 and 32 to those frequencies where a substantial difference in level is expected. A band in which a substantial difference in level is expected may be referred to as a stable band differential β. The magnitude of the difference is such that minor adjustments or changes in the monitored levels should not cause false indications of an insertion or removal.

For example, for the response depicted in FIG. 1, a stable band differential β is in the frequency range of approximately 200 to 500 Hz. Accordingly, the bandpass filters 24 and 34 will have a lower cutoff of 200 Hz and an upper cutoff of 500 Hz. The minimum magnitude of the difference between the two curves is approximately 18 dB. In a digital-signal processing (DSP) implementation, the bandpass filters 24 and 34 may also be realized by the output of one or more frequency bins of a Fast Fourier Transform (FFT) within this range.

In the embodiments shown, the level detectors 26 and 36 estimate the RMS levels simultaneously present at the input to the loudspeaker 20 and the output of the microphone 30. Other averaging estimations may also be used instead of RMS level averages.

Figure 4:
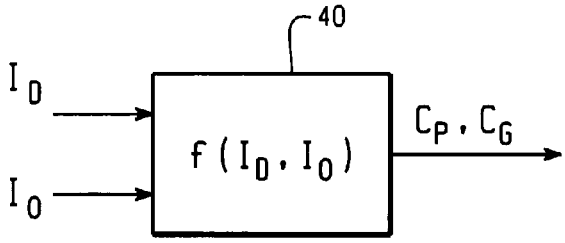
FIG. 4 is a block diagram of a signal processing circuitry operable to generate control signals based on monitored signal levels.

FIG. 4 is a block diagram of a signal processing circuitry 40 operable to generate control signals based on monitored signal levels $I_D$ and $I_O$. The intensity levels $I_D$ and $I_O$ are compared to determine if the loudspeaker 20 is driving into a sealed acoustic cavity. In one embodiment, the ratio of these levels is used to decide if the loudspeaker 20 is driving into a sealed acoustic cavity. The signal processing circuitry 40 may be realized by a programmable microprocessor, an Application Specific Integrated Circuit (ASIC), a programmable gate array, or other similar circuitry. Alternatively, the signal processing circuitry 40 may be realized by analog processing circuitry.

The expected ratio of the signal levels $I_D$ and $I_O$ under the sealed and unsealed conditions is derived from knowledge of the electro-acoustic transfer function from the loudspeaker 20 to the microphone 30 under the various operating conditions. For example, data related to the signal levels $I_D$ and $I_O$ may be obtained by monitoring the $I_D$ and $I_O$ intensity levels during several frequency sweeps of the electrical signal driving the loudspeaker 20 when the hearing instrument 10 is inserted into a cavity and when the hearing instrument 10 is removed from the cavity. Alternatively, the data can be either measured using a system calibration, or derived from models of the transducers, amplifiers and acoustic cavity, or gathered in an adaptive fashion by a processing circuitry that continuously monitors the signal levels.

The data related to the signal levels $I_D$ and $I_O$ may then be processed to obtain the response ratios of FIG. 1, which in turn may be referenced to determine whether the hearing instrument is inserted into a space or removed from a space. In the response depicted in FIG. 1, for example, at a frequency of 200 Hz, a ratio of acoustic output to loudspeaker drive of about −3 dB would indicate a sealed cavity, and a ratio of −25 dB would indicate an open cavity.

Upon determining whether the hearing instrument 10 is removed or inserted into a space, correspond gain control signals $C_G$ and/or power control signals $C_P$ can be generated. The gain controls signal $C_G$ may be used to reduce the gain on an output amplifier driving the loudspeaker 20, or reduce the gain on a microphone receiving an input signal to generate a drive signal for the loudspeaker 20 upon detecting that the hearing instrument 10 has been removed from the space, thus preventing howling. Additionally, upon detecting that the hearing instrument 10 has been inserted into the space, the control signal $C_G$ may be used to increase the hearing instrument gain to a normal operating parameter. The power control signal $C_P$ may be used to deactivate the hearing instrument 10 after the hearing instrument 10 has been removed from the space and after a period of time has elapsed during which the hearing instrument 10 has not been reinserted into the space. Accordingly, automatic gain reduction for the hearing instrument 10 removed from the ear and automatic power reduction for hearing instrument 10 removed from the ear may be realized.

Other functions may also be supported by the detection of the insertion or removal of the hearing instrument 10. For example, automatic calibration checks may be triggered during each insertion of the hearing instrument 10, or may be triggered after a given number of insertions and removals. Adaptive identification of on and off signals levels may also be facilitated to eliminate system calibration.

Figure 5:
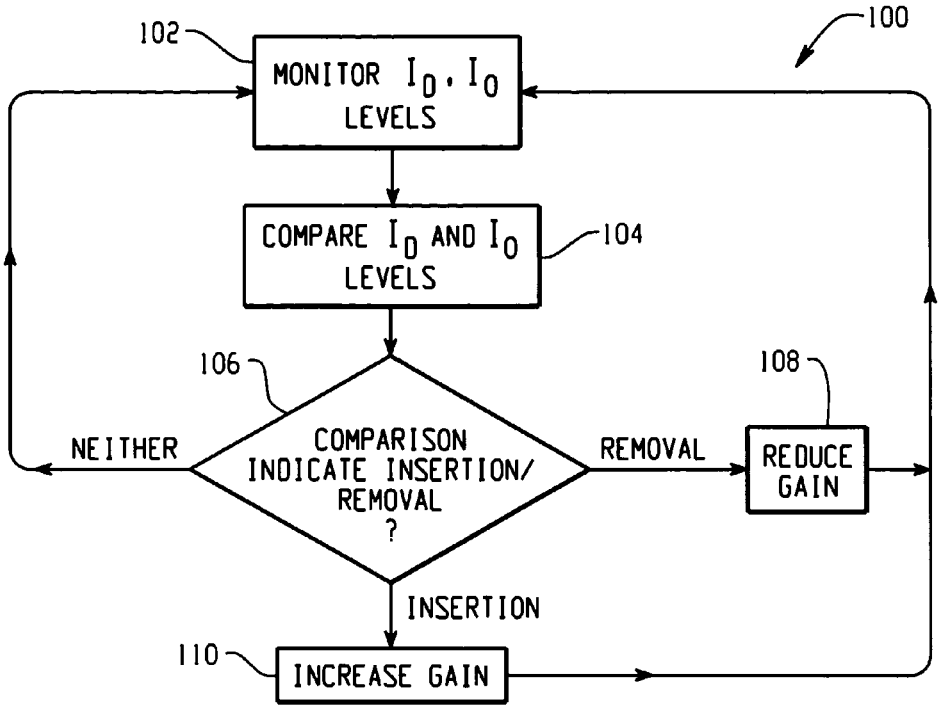
FIG. 5 is a process flow diagram illustrating a method of automatically altering a hearing instrument state based on a detected insertion or removal event.

The signal processing circuitry 40 may be configured to implement one or more processing methods to control the hearing instrument 10 based on the detection of an insertion or removal of the hearing instrument 10 into a space. FIG. 5 is a process flow diagram 100 illustrating a method of automatically altering the hearing instrument state based on a detected insertion or removal event. In step 102, signal processing circuitry monitors the intensity levels $I_D$ and $I_O$, and the monitored levels are compared in step 104. In step 106, the signal processing circuitry determines whether the comparison of step 104 indicates that the hearing instrument has been removed, inserted, or if neither of these events have occurred. If neither of these events have occurred, indicating that the hearing instrument has not been removed if it is presently inserted into the space, or that the hearing instrument has not been inserted if it is presently removed from the space, then the process returns to step 102.

If the comparison of step 104 indicates that the hearing instrument has been removed from the space, then in step 108 the gain of the hearing instrument is reduced, and the process returns to step 102. Conversely, if the comparison of step 104 indicates that the hearing instrument has been inserted into the space, then in step 110 the gain of the hearing instrument is increased and the process returns to step 102.

In the embodiment shown, the comparison step is based on a ratio of the intensity levels $I_D$ and $I_O$. In one embodiment, the comparison compares the ratio from a previously monitored ratio, and if the compared ratios have changed substantially, then a removal or insertion event has occurred. By way of example, consider the graph of FIG. 1. At a frequency of 200 Hz, the ratio of the intensity levels $I_D$ and $I_O$ is approximately −3 dB when the hearing instrument is inserted into the space. As long as successive comparisons are within this range, the signal processing circuitry will determine that the hearing instrument is inserted in the space and remains inserted. When the hearing instrument is removed from the space, the ratio of the intensity levels $I_D$ and $I_O$ is approximately −25 dB at 200 Hz. Thus, successive comparisons will indicate a substantial negative change in the ratio, indicating that that hearing instrument has been removed from the space. Conversely, successive comparisons that indicate a substantial positive change in the ratio indicate that the hearing instrument has been inserted into the space.

In another embodiment, the ratio of the intensity levels $I_D$ and $I_O$ is compared to a threshold. For example, in the graph of FIG. 1, a threshold may be defined between the two averages of the ratios of the intensity levels $I_D$ and $I_O$ over the band β, e.g., −13 dB. A ratio of the intensity levels $I_D$ and $I_O$ above −13 dB indicates that the hearing instrument is inserted into the space, while a ratio of the intensity levels $I_D$ and $I_O$ less than −13 dB indicates that the hearing instrument is not inserted into the space.

A hysteresis may also be used in the comparison to prevent cycling of gain reduction and increase. For example, if the ratio of the intensity levels $I_D$ and $I_O$ fall below −13 dB, indicating that the hearing instrument is removed from the space, the signal processing circuitry may then be configured to detect an insertion only if the ratios of the intensity levels $I_D$ and $I_O$ thereafter rise above −10 dB. Similarly, if the ratio of the intensity levels $I_D$ and $I_O$ rise above −13 dB, indicating that the hearing instrument is inserted the space, the signal processing circuitry may then be configured to detect a removal only if the ratios of the intensity levels $I_D$ and $I_O$ thereafter fall below −16 dB. Other hysteresis levels and processes may also be used.

Figure 6:
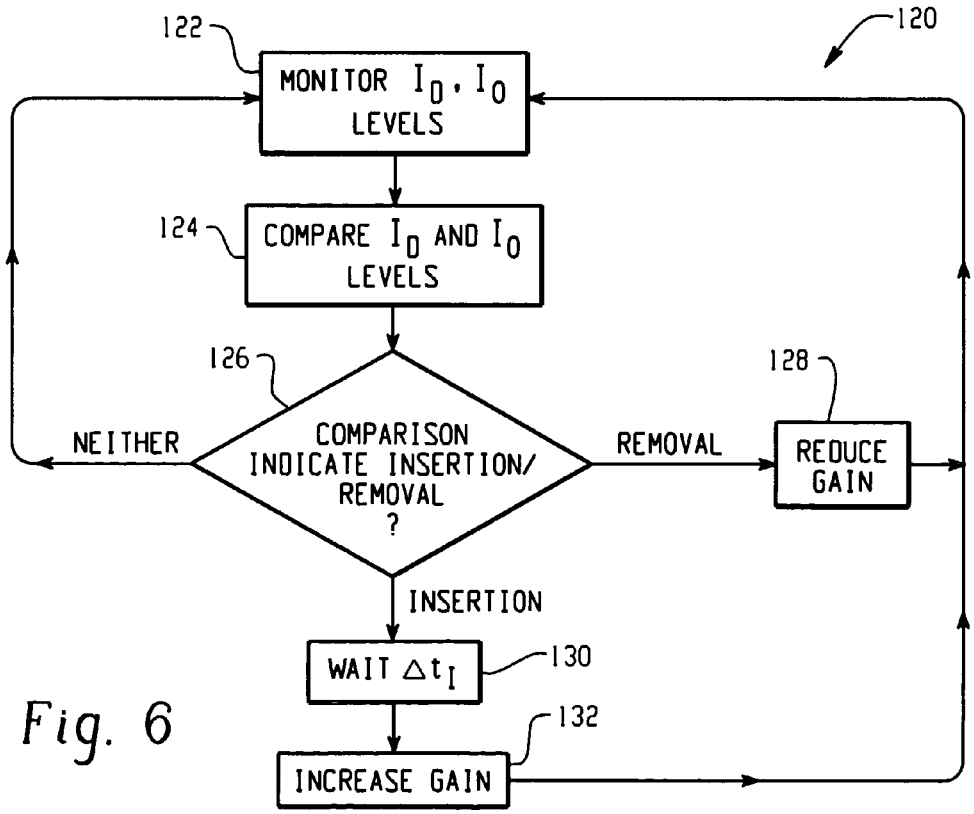
FIG. 6 is a process flow diagram illustrating a method of automatically altering a hearing instrument state based on a detected insertion or removal event and subject to an insertion event time delay.

FIG. 6 is a process flow diagram 120 illustrating a method of automatically altering a hearing instrument state based on a detected insertion or removal event and subject to an insertion event time delay $\Delta t_I$. The insertion event time delay $\Delta t_I$ is a time delay that precludes the gain of the hearing instrument from being increased as the user inserts the hearing instrument into the ear canal. Under certain conditions, increasing the gain too quickly may cause howling while the user is inserting the hearing instrument into the ear canal. For example, if the user inserts the hearing instrument and the gain is increased, the user may experience howling if he or she further adjusts the hearing instrument to obtain a more comfortable fit. The duration of the insertion event time delay $\Delta t_I$ is thus selected to ensure that the user has enough time to comfortably fit the hearing instrument into the ear canal before the gain is increased.

In step 122, the signal processing circuitry monitors the intensity levels $I_D$ and $I_O$, and the monitored levels are compared in step 124. In step 126, the signal processing circuitry determines whether the comparison of step 124 indicates that the hearing instrument has been removed, inserted, or if neither of these events have occurred. If neither of these events have occurred, indicating that the hearing instrument has not been removed if it is presently inserted into the space, or that the hearing instrument has not been inserted if it is presently removed from the space, then the process returns to step 122.

If the comparison of step 124 indicates that the hearing instrument has been removed from the space, then in step 128 the gain of the hearing instrument is reduced, and the process returns to step 122. Conversely, if the comparison of step 124 indicates that the hearing instrument has been inserted into the space, then in step 130 the signal processing circuitry waits for an insertion time delay $\Delta t_I$, and then in step 132 the gain of the hearing instrument is increased. The process then returns to step 122.

Figure 7:
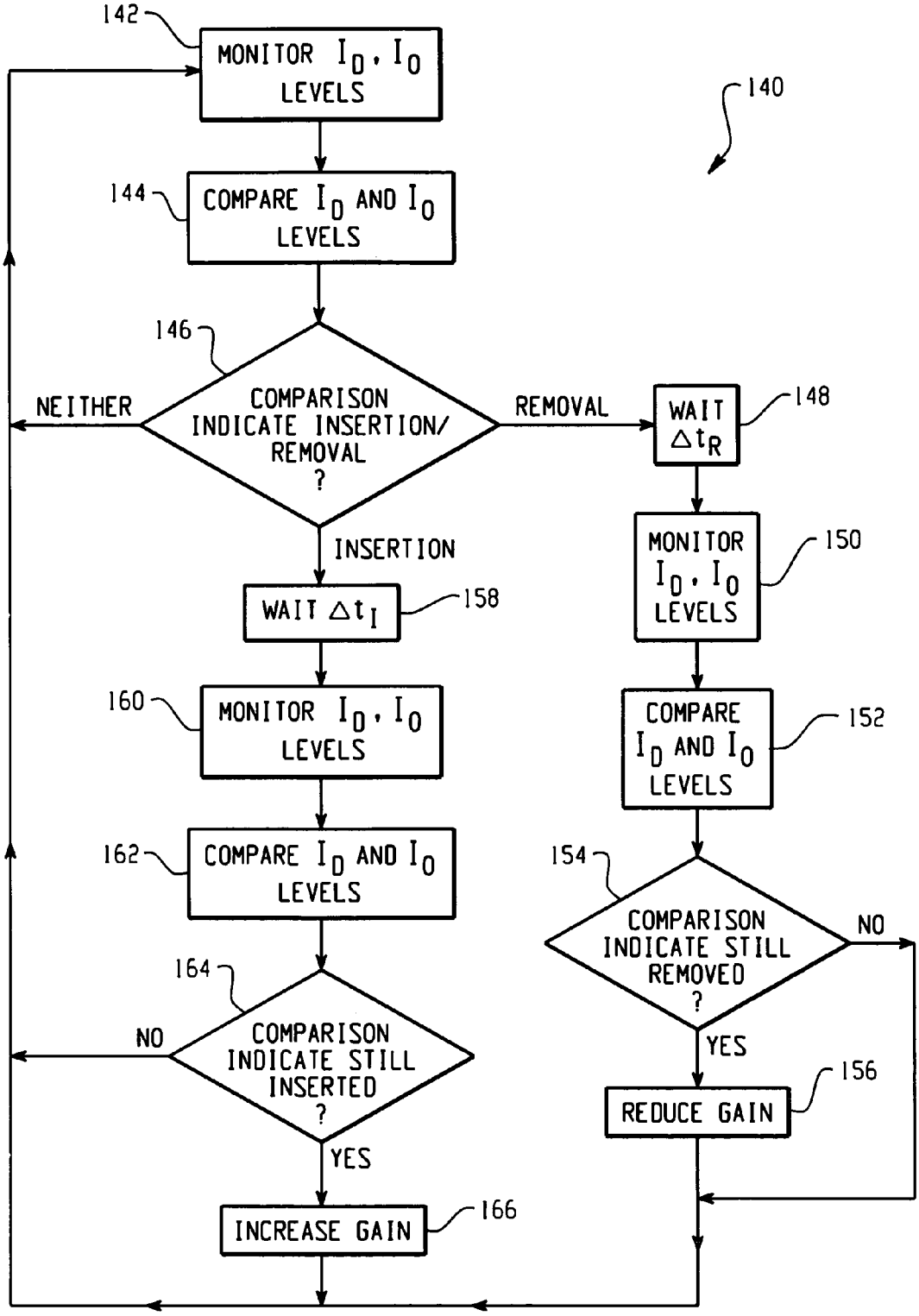
FIG. 7 is a process flow diagram illustrating a method of automatically altering a hearing instrument state based on a detected insertion or removal event and subject to a corresponding hysteresis condition.

FIG. 7 is a process flow diagram 140 illustrating a method of automatically altering a hearing instrument state based on a detected insertion or removal event and subject to a corresponding hysteresis condition. An insertion event time delay $\Delta t_I$ is included to ensure that the gain of the hearing instrument is not increased as the user inserts the hearing instrument. Likewise, a removal event time delay $\Delta t_R$ is included to ensure that the gain is not decreased as the user adjusts, and does not remove, the hearing instrument. Typically, the removal event time delay $\Delta t_R$ is a short time delay so as to allow gain reduction and preclude howling if the user is actually removing the hearing instrument.

In step 142, signal processing circuitry monitors the intensity levels $I_D$ and $I_O$, and the monitored levels are compared in step 144. In step 146, the signal processing circuitry determines whether the comparison of step 144 indicates that the hearing instrument has been removed, inserted, or if neither of these events have occurred. If neither of these events have occurred, indicating that the hearing instrument has not been removed if it is presently inserted into the space, or that the hearing instrument has not been inserted if it is presently removed from the space, then the process returns to step 142.

If the comparison of step 144 indicates that the hearing instrument has been removed from the space, then the processing circuitry waits for a removal time delay $\Delta t_R$ in step 148, and then monitors the intensity levels $I_D$ and $I_O$ in step 150, and compares the monitored levels in step 152. In step 154, the processing circuitry determines if the comparison indicates that the hearing instrument is still removed from the space. If so, then the gain is reduced in step 156, and the process returns to step 142. If the processing circuitry, however, determines that the comparison indicates that the hearing instrument is not removed from the space, then the gain remains unchanged and the process returns to step 142.

Returning to step 146, if the comparison of step 144 indicates that the hearing instrument has been inserted into the space, then the processing circuitry waits for an insertion time delay $\Delta t_I$ in step 158, and then monitors the intensity levels $I_D$ and $I_O$ in step 160, and compares the monitored levels in step 162. In step 164, the processing circuitry determines if the comparison indicates that the hearing instrument is still inserted into the space. If so, then the gain is increased in step 166, and the process returns to step 142. If, however, the processing circuitry determines that the comparison indicates that the hearing instrument is not inserted the space, then the gain remains unchanged and the process returns to step 142.

Figure 8:
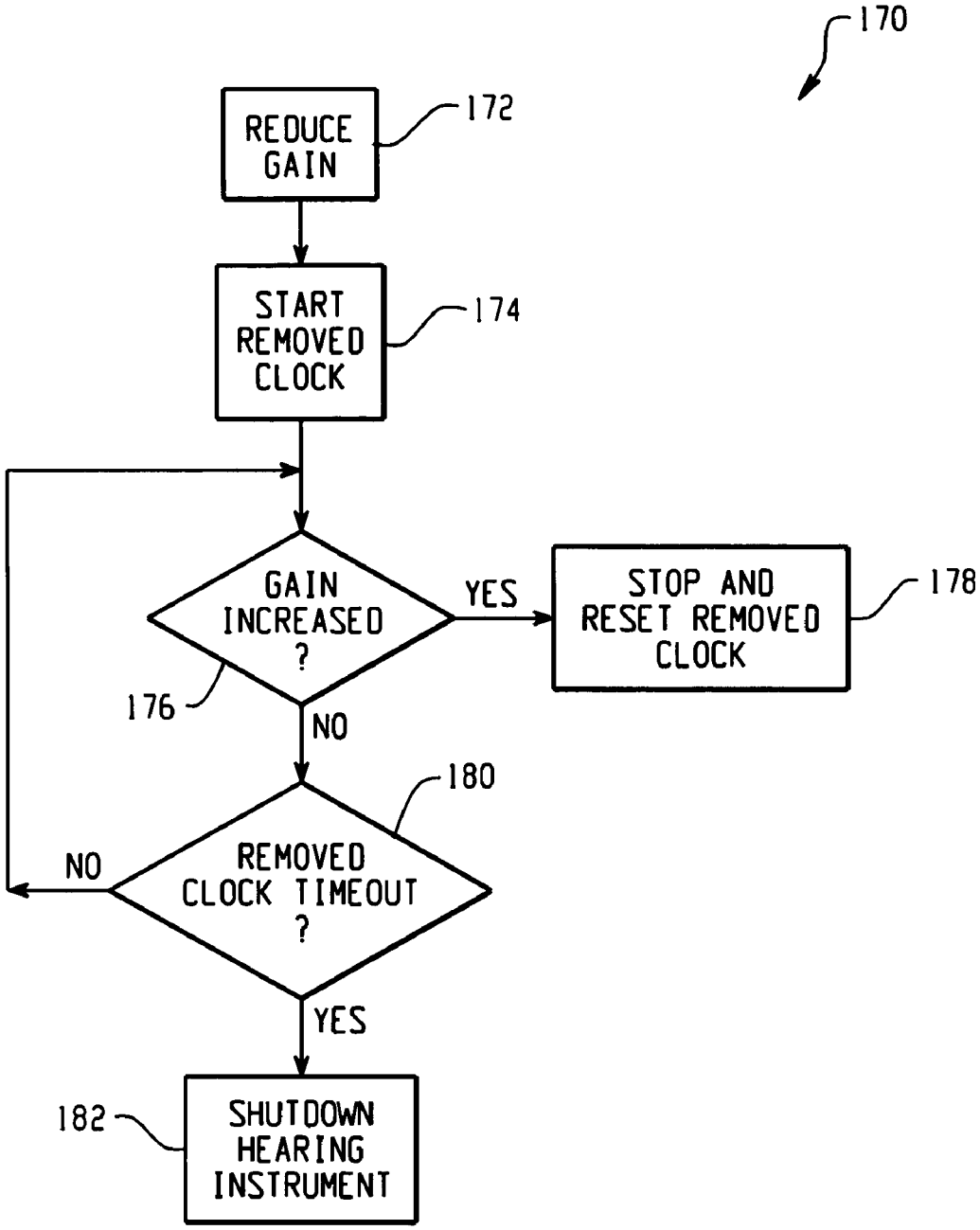
FIG. 8 is a process flow diagram illustrating a method of automatically shutting off a hearing instrument based on a removal event.

FIG. 8 is a process flow diagram 170 illustrating a method of automatically shutting off a hearing instrument based on a removal event. After the gain has been reduced in step 172, the hearing instrument starts a removed clock in step 174. In step 176, the hearing instrument determines if the gain has been increased. Increasing the gain indicates that the hearing instrument has been inserted back into the ear canal. Upon a positive determination in step 176, step 178 stops and resets the removed clock.

Conversely, upon a negative determination in step 176, the processing circuitry determines if a removed clock timeout has occurred in step 180. If a removed clock timeout has not occurred, then the process returns to step 176. If a removed clock timeout has occurred, however, then the hearing instrument is shut down in step 182 to conserve battery power.

Other methods of conserving battery power may also be used. For example, instead of reducing gain upon the detection of a removal event, the hearing instrument may automatically power down upon such detection. Alternatively, if the monitoring band is in the low frequency range, such as the band β shown in FIG. 1, then the processing circuitry may adjust to perform signal processing up to the upper limit of this band. Sampling rate and clock speed may then be reduced accordingly to conserve power.

Figure 9:
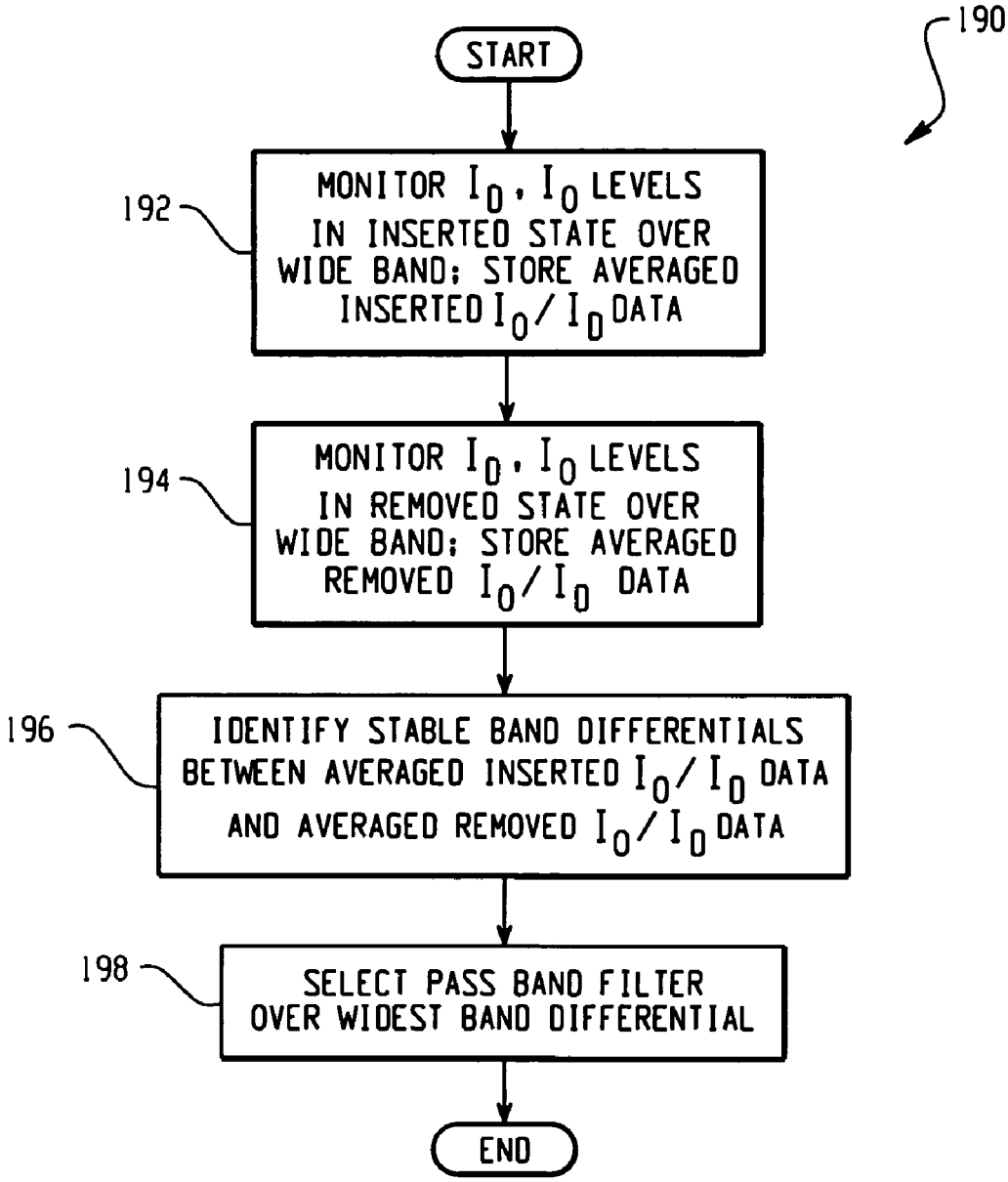
FIG. 9 is a process flow diagram illustrating adaptive selection of a monitoring band for detecting an insertion or removal event.
Figure 10:
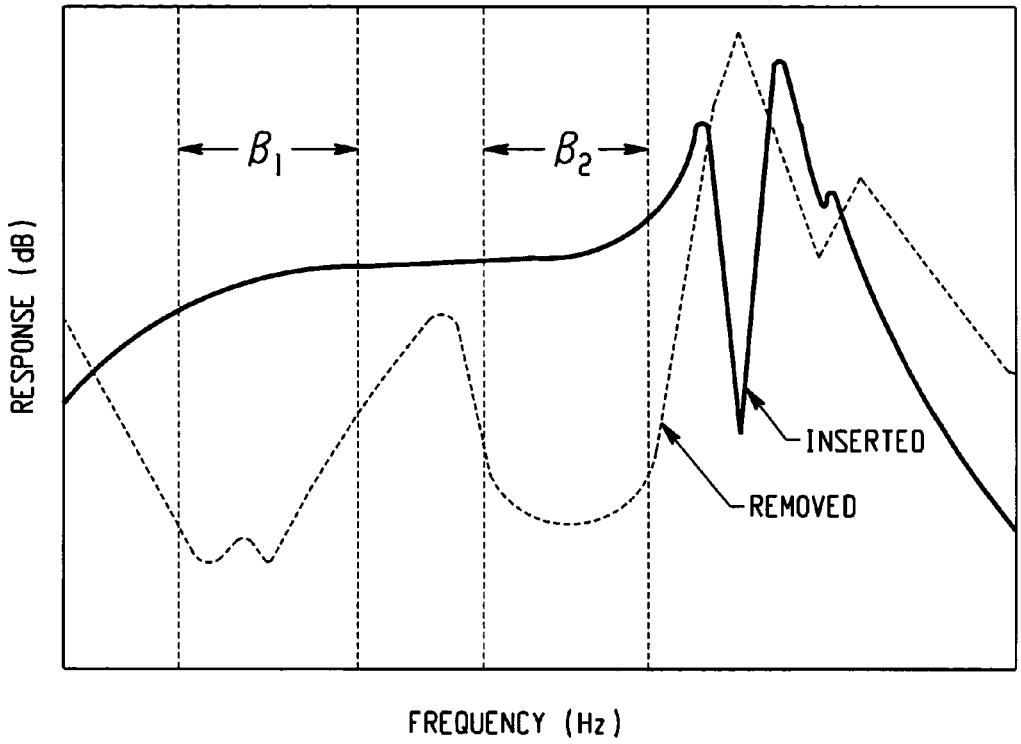
FIG. 10 is a graph of monitored data and two candidate monitoring bands for detecting an insertion or removal event.

While the frequency bands to be monitored may be selected during a configuration of the hearing instrument, such as when an audiologist first fits a user with an hearing aid, the processing circuitry may also be configured to automatically adjust or automatically select the frequency bands to be monitored. FIG. 9 is a process flow diagram 190 illustrating adaptive selection of a monitoring band for detecting an insertion or removal event, and FIG. 10 is a graph of monitored data and two candidate monitoring bands for detecting an insertion or removal event. The process of FIG. 9 may be used to select the monitor band during the initial fitting of the hearing instrument, or to adjust or select the monitor band at any time thereafter.

In step 192, the signal processing circuitry monitors the intensity levels $I_O$ and $I_D$ in an inserted state over a wide frequency band, and stores the averaged inserted $I_O/I_D$ ratio data. FIG. 10 illustrates an example of the averaged inserted $I_O/I_D$ ratio data. Similarly, in step 194, the signal processing circuitry monitors the intensity levels $I_O$ and $I_D$ in a removed state over a wide frequency band, and stores the averaged removed $I_O/I_D$ ratio data. FIG. 10 illustrates an example of the averaged removed $I_O/I_D$ ratio data.

In step 196, the signal processing circuitry identifies stable band differentials between the averaged inserted $I_O/I_D$ ratio data and the averaged removed $I_O/I_D$ ratio data. A stable band differential is a region in which there is a substantial difference in ratio levels. For example, the data of FIG. 10 indicates that there are two stable band differentials, $\beta_1$ and $\beta_2$. The signal processing circuitry may select one of stable band differentials for the monitoring of insertion and removal events, or may even monitor both stable band differentials for such monitoring.

The systems and methods herein may also be used to detect or measure how well a hearing instrument forms a seal with a user's ear. The seal may be measured by monitoring the frequency response ratio of $I_O$ and $I_D$ and comparing the monitored ratio to an ideal ratio or a previously measured known ratio. For example, during the fitting of a hearing instrument, and audiologist may obtain a mold of a user's ear canal and the hearing instrument may be constructed to according to the mold. Upon receiving the completed hearing instrument, the audiologist may test the hearing instrument in a controlled setting, such as an adjustable test mold, to obtain an ideal, or near ideal, frequency response ratio of $I_O$ and $I_D$ of the hearing instrument. This controlled frequency response ratio of $I_O$ and $I_D$ may then be used to establish a baseline by which to measure the actual fit within the user's ear canal.

Figure 11:
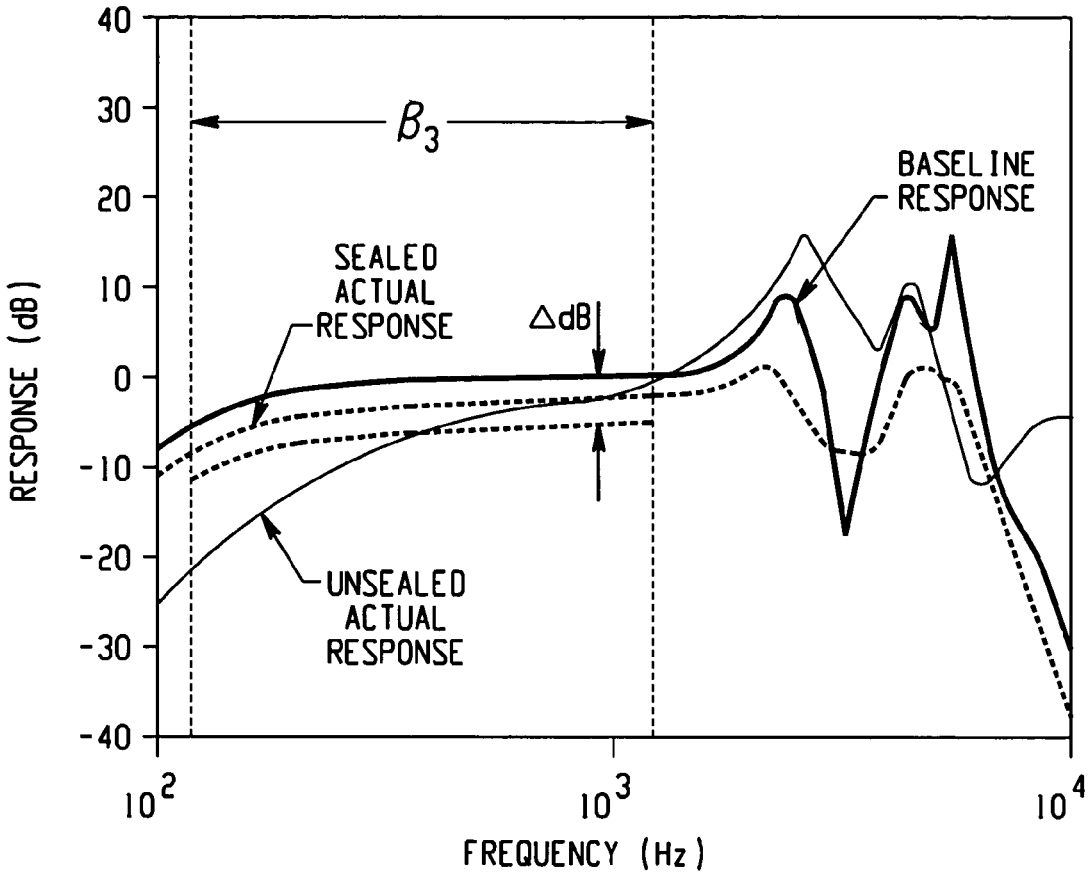
FIG. 11 is a graph of a monitored baseline response, and two monitored actual responses.

For example, FIG. 11 is a graph of a monitored baseline response and two monitored actual responses. The baseline response is the frequency response ratio of $I_O$ and $I_D$ for the hearing instrument in a well sealed cavity, e.g., a test mold that may receive the hearing instrument and form a very good seal. After the baseline frequency response ratio of $I_O$ and $I_D$ is obtained, the audiologist will fit the hearing instrument into the ear canal of the user and obtain an actual frequency response ratio of $I_O$ and $I_D$. The actual response ratio of $I_O$ and $I_D$ may then be compared to the baseline frequency response ratio of $I_O$ and $I_D$ to determine whether the hearing instrument has formed an adequate seal in the ear canal.

In one embodiment, the comparison is made over a low frequency band $\beta_3$. The "sealed actual response" is an example actual response within a threshold level of the baseline response over the band $\beta_3$ and indicates a well-sealed hearing instrument. Conversely, the "unsealed actual response" is an example actual response this is not within the threshold level of the baseline response over the band $\beta_3$ and indicates a poorly-sealed hearing instrument. An unsealed actual response may be due to the hearing instrument needing adjustment in the ear canal to close the seal, or may be due to the hearing instrument dimensions not matching the user's ear canal so that a seal cannot be obtained. In the latter case, the audiologist may need to take another mold of the ear canal and have another hearing instrument constructed.

In the embodiment shown, the determination of a sealed response or an unsealed response is based on the actual response being within a threshold intensity level ΔdB of the baseline response, e.g., −3 dB. If the response is not within the threshold ΔdB over the entire band $\beta_3$, or a substantial portion of the band $\beta_3$, then the hearing instrument is determined to be unsealed. Conversely, if the response is within the threshold ΔdB over the entire band $\beta_3$, or a substantial portion of the band $\beta_3$, then the hearing instrument is determined to be sealed. While the threshold ΔdB has been illustrated as constant threshold over the band $\beta_3$, the threshold $\beta_3$ may also vary over the band ΔdB, e.g., ΔdB may be −6 dB at the lower cutoff frequency, and may be −3 dB at the upper cutoff frequency.

In another embodiment, the system and method described with respect to FIG. 11 may be used to monitor the seal of the hearing instrument while in use. If an unsealed detection occurs, as would be the case when the unsealed actual response is below the threshold ΔdB but not so far below as to indicate removal, then the hearing instrument may issue a periodic tone to notify the user that the hearing instrument requires a fitting adjustment or service.

In another embodiment, the system and method described with respect to FIG. 11 may be used to monitor occlusion levels. The occlusion level is determined by comparing the actual response to the baseline response.

While the system and methods of FIGS. 1-11 has been described primarily in the context of a hearing instrument that is inserted into an ear canal, the system and methods may likewise be used to monitor the placement of a hearing instrument in the vicinity of an ear, such as a communication headset or headphone. Intensity levels may be monitored to obtain the acoustic characteristics of the hearing instrument when the hearing instrument is placed against the ear, and when the hearing instrument is removed from the ear. These intensity levels may then be used to monitor and detect similar events as described with respect to FIGS. 1-11 above. Likewise, a baseline response and an actual response may be measured to determine whether an acceptable seal is formed between the headset and the user's ear.

The embodiments described herein are examples of structures, systems or methods having elements corresponding to the elements of the invention recited in the claims. This written description may enable those of ordinary skill in the art to make and use embodiments having alternative elements that likewise correspond to the elements of the invention recited in the claims. The intended scope of the invention thus includes other structures, systems or methods that do not differ from the literal language of the claims, and further includes other structures, systems or methods with insubstantial differences from the literal language of the claims.

What is claimed is:

1. A hearing instrument system for detecting the insertion or removal of a hearing instrument into an ear canal of a hearing instrument user, the hearing instrument being configured to occlude the ear canal, comprising:

a first acoustic transducer configured to receive a first electrical signal and in response radiate acoustic energy;

first level detection circuitry coupled to the first acoustic transducer and operable to receive the first electrical signal and generate a first intensity signal;

a second acoustic transducer configured to receive radiated acoustic energy and in response generate a second electrical signal; the second acoustic transducer being a microphone that is positioned to receive radiated acoustic energy from inside of the occluded ear canal of the hearing instrument user;

second level detection circuitry coupled to the second acoustic transducer and operable to receive the second electrical signal and generate a second intensity signal; and signal processing circuitry coupled to the first and second level detection circuitry and operable to receive the first and second intensity signals and compare the first and second intensity signals and determine whether the hearing instrument is inserted into the ear canal or removed based on the comparison.

2. The hearing instrument system of claim 1, wherein the first and second electrical signals received by the first and second level detection circuitry correspond to a stable band differential.

3. The hearing instrument system of claim 2, wherein the stable band differential corresponds to a frequency band defining a lower frequency and an upper frequency, the upper frequency less than or equal to 10 kilohertz.

4. The hearing instrument system of claim 1, wherein the signal processing circuitry is further operable to reduce a gain associated with the first acoustic transducer upon detection that the hearing instrument is removed from the ear canal.

5. The hearing instrument system of claim 4, wherein the signal processing circuitry is further operable to power off the hearing instrument if the signal processing circuitry does not detect an insertion into the ear canal within a specified time period after the detection that the hearing instrument has been removed from the ear canal.

6. The hearing instrument system of claim 4, wherein the signal processing circuitry is further operable to increase the gain associated with the first acoustic transducer upon detection that the hearing instrument is inserted into the ear canal.

7. The hearing instrument system of claim 4, wherein the signal processing circuitry is further operable to increase the gain associated with the first acoustic transducer after a specified time period after the detection that the hearing instrument is inserted into the ear canal.

8. The hearing instrument system of claim 1, wherein the signal processing circuitry is further operable to:

monitor the level of acoustic energy radiated by the first transducer over a frequency band;

monitor the level of acoustic energy received by the second acoustic transducer over a frequency band in response to the acoustic energy radiated by the first acoustic transducer when the hearing instrument is inserted into the ear canal;

compare the level of acoustic energy received by the second acoustic transducer over a frequency band in response to the acoustic energy radiated by the first acoustic transducer to obtain first comparison data;

monitor the level of acoustic energy received by the second acoustic transducer over the frequency band in response to the acoustic energy radiated by the first acoustic transducer when the hearing instrument is removed from the ear canal;

compare the level of acoustic energy radiated by the second acoustic transducer to the level of acoustic energy received by the first acoustic transducer over the frequency band when the hearing instrument is removed from the ear canal to obtain second comparison data; and identify stable band differentials between the first comparison data and the second comparison data for the monitoring insertion and removal events.

9. The hearing instrument system of claim 1, wherein the hearing instrument is a hearing aid.

10. The hearing instrument system of claim 1, wherein the hearing instrument is a communications device.

11. The hearing instrument system of claim 1, wherein the first and second level detection circuitry comprises first and second bandpass filters, respectively, and first and second level detectors, respectively.

12. An electronically-implemented method of determining whether a hearing instrument is removed from or inserted into an ear canal of a hearing instrument user, the hearing instrument being configured to occlude the ear canal, comprising:

monitoring the level of acoustic energy radiated by the hearing instrument;

monitoring the level of acoustic energy received by the hearing instrument in response to the acoustic energy radiated by the hearing instrument using a microphone that is positioned to receive acoustic energy from inside of the ear canal when the hearing instrument is inserted into the ear canal;

comparing the level of acoustic energy radiated by the hearing instrument to the level of acoustic energy received by the hearing instrument in response to the acoustic energy radiated by the hearing instrument;

determining that the hearing instrument is removed from the ear canal if the level of acoustic energy received by the hearing instrument is less than the level of acoustic energy radiated by the hearing instrument by a threshold amount;

determining that the hearing instrument is inserted into the ear canal if the level of acoustic energy received by the hearing instrument is not less than the level of acoustic energy radiated by the hearing instrument by the threshold amount; and controlling power consumption or acoustic gain of the hearing instrument based on the determination of whether the hearing instrument is inserted into the ear canal or removed from the ear canal.

13. The method of claim 12, wherein the monitoring steps comprise monitoring over a stable band differential.

14. The method of claim 13, wherein the stable band differential corresponds to a frequency band defining a lower frequency and an upper frequency, the upper frequency less than or equal to 10 kilohertz.

15. An electronically-implemented method of determining whether a hearing instrument is removed from or inserted into an ear canal of a hearing instrument user, the hearing instrument being configured to occlude the ear canal, comprising:

monitoring the level of acoustic energy radiated by the hearing instrument;

monitoring the level of acoustic energy received by the hearing instrument in response to the acoustic energy radiated by the hearing instrument using a microphone that is positioned to receive acoustic energy from inside of the ear canal when the hearing instrument is inserted into the ear canal;

comparing the level of acoustic energy radiated by the hearing instrument to the level of acoustic energy received by the hearing instrument in response to the acoustic energy radiated by the hearing instrument;

determining whether the hearing instrument is inserted into the ear canal or removed from the ear canal based on the comparison;

controlling power consumption or acoustic gain of the hearing instrument based on the determination of whether the hearing instrument is inserted into the ear canal or removed from the ear canal; and reducing a gain associated with the acoustic energy radiated by the hearing instrument upon detection that the hearing instrument is removed from the ear canal.

16. The method of claim 15, further comprising powering off the hearing instrument if a determination that an insertion into the ear canal does not occur within a specified time period after the detection that the hearing instrument has been removed from the ear canal.

17. The method of claim 15, further comprising increasing the gain associated with acoustic energy radiated by the hearing instrument upon detection that the hearing instrument is inserted into the ear canal.

18. The method of claim 15, further comprising increasing the gain associated with acoustic energy radiated by the hearing instrument after a specified time period after the detection that the hearing instrument is inserted into the ear canal.

19. An electronically-implemented method of determining whether a hearing instrument is removed from or inserted into an ear canal of a hearing instrument user, the hearing instrument being configured to occlude the ear canal, comprising:

monitoring the level of acoustic energy radiated by the hearing instrument;

monitoring the level of acoustic energy received by the hearing instrument in response to the acoustic energy radiated by the hearing instrument using a microphone that is positioned to receive acoustic energy from inside of the ear canal when the hearing instrument is inserted into the ear canal;

comparing the level of acoustic energy radiated by the hearing instrument to the level of acoustic energy received by the hearing instrument in response to the acoustic energy radiated by the hearing instrument;

determining whether the hearing instrument is inserted into the ear canal or removed from the ear canal based on the comparison;

controlling power consumption or acoustic gain of the hearing instrument based on the determination of whether the hearing instrument is inserted into the ear canal or removed from the ear canal;

monitoring the level of acoustic energy radiated by the hearing instrument over a frequency band;

monitoring the level of acoustic energy received by the hearing instrument over the frequency band in response to the acoustic energy radiated by the hearing instrument when the hearing instrument is inserted into the ear canal;

comparing the level of acoustic energy radiated by the hearing instrument to the level of acoustic energy received by the hearing instrument over the frequency band when the hearing instrument is inserted into the ear canal to obtain first comparison data;

monitoring the level of acoustic energy received by the hearing instrument over the frequency band in response to the acoustic energy radiated by the hearing instrument when the hearing instrument is removed from the ear canal;

comparing the level of acoustic energy radiated by the hearing instrument to the level of acoustic energy received by the hearing instrument over the frequency band when the hearing instrument is removed from the ear canal to obtain second comparison data; and identifying stable band differentials between the first comparison data and the second comparison data for the monitoring insertion and removal events.

20. A hearing instrument that is configured to occlude an ear canal of a hearing instrument user, comprising:

means for monitoring the level of acoustic energy radiated by the hearing instrument;

a microphone that is positioned to receive acoustic energy from inside of the occluded ear canal of the hearing instrument user and to monitor the level of acoustic energy received by the hearing instrument in response to the acoustic energy radiated by the hearing instrument; and means for comparing the level of acoustic energy radiated by the hearing instrument to the level of acoustic energy received by the hearing instrument in response to the acoustic energy radiated by the hearing instrument and for determining whether the hearing instrument system is inserted into the space or removed from the space based on the comparison, wherein said determining of whether the hearing instrument system is inserted into the space or removed from the space includes concluding said hearing instrument system is removed from the space if the level of acoustic energy received by the hearing instrument is less than the level of acoustic energy radiated by the hearing instrument system by a threshold amount; and concluding that the hearing instrument system is inserted into the space if the level of acoustic energy received by the hearing instrument is not less than the level of acoustic energy radiated by the hearing instrument system by the threshold amount.

21. A method of determining whether a hearing instrument is removed from or inserted into a ear canal of a hearing instrument user, the hearing instrument being configured to occlude the ear canal when inserted, comprising:

monitoring the level of acoustic energy radiated by the hearing instrument over a frequency band;

monitoring the level of acoustic energy received by the hearing instrument over the frequency band in response to the acoustic energy radiated by the hearing instrument when the hearing instrument is inserted into the ear canal using a microphone that is positioned to receive acoustic energy from inside of the occluded ear canal;

comparing the level of acoustic energy radiated by the hearing instrument to the level of acoustic energy received by the hearing instrument over the frequency band when the hearing instrument is inserted into the ear canal to obtain first comparison data;

monitoring the level of acoustic energy received by the hearing instrument over the frequency band in response to the acoustic energy radiated by the hearing instrument when the hearing instrument is removed from the ear canal;

comparing the level of acoustic energy radiated by the hearing instrument to the level of acoustic energy received by the hearing instrument over the frequency band when the hearing instrument is removed from the ear canal to obtain second comparison data; and identifying stable band differentials between the first comparison data and the second comparison data for the monitoring insertion and removal events; and controlling at least one of power consumption or acoustic gain based on the determination of whether the hearing instrument is removed from or inserted into the ear canal.

22. The method of claim 21, wherein identifying stable band differentials between the first comparison data and the second comparison data for the monitoring insertion and removal events comprises:

obtaining a ratio of the first comparison data to the second comparison data; and determining if the change in ratio over a bandwidth is within a defined range.

23. The method of claim 21, wherein the frequency band defines a lower frequency and an upper frequency, the upper frequency less than or equal to 10 kilohertz.

24. A hearing instrument system for determining a hearing instrument seal with a user's ear, comprising:

a first acoustic transducer configured to receive a first electrical signal and in response radiate acoustic energy;

first level detection circuitry coupled to the first acoustic transducer and operable to receive the first electrical signal and generate a first intensity signal;

a second acoustic transducer configured to receive radiated acoustic energy and in response generate a second electrical signal the second acoustic transducer including a microphone that is positioned to receive radiated acoustic energy from inside of the user's sealed ear;

second level detection circuitry coupled to the second acoustic transducer and operable to receive the second electrical signal and generate a second intensity signal; and signal processing circuitry coupled to the first and second level detection circuitry and operable to receive the first and second intensity signals and compare a ratio of the first and second intensity signals to a baseline ratio of the first and second intensity signals to determine whether the hearing instrument has formed an acceptable seal with the user's ear.

25. The hearing instrument system of claim 24, wherein the signal processing circuitry is operable to determine whether the hearing instrument has formed an acceptable seal with the user's ear by determining whether the ratio of the first and second intensity signals is within a threshold level of the baseline ratio over a frequency band.

26. The hearing instrument system of claim 25, wherein the threshold level is constant over the frequency band.

27. The hearing instrument system of claim 25, wherein the threshold level varies over the frequency band.

28. The hearing instrument system of claim 24, wherein the signal processing circuitry is operable to cause the first acoustic transducer to periodically radiate a notification tone upon determining that the hearing instrument has not formed an acceptable seal with the user's ear.

29. The hearing instrument system of claim 24, wherein the hearing instrument is a hearing aid.

* * * * *